United States Patent [19]

Matsumuro

[11] Patent Number: 4,792,789

[45] Date of Patent: Dec. 20, 1988

[54] ALARM DRIVING SIGNAL GENERATOR

[75] Inventor: Yoshiaki Matsumuro, Shizuoka, Japan

[73] Assignee: Yazaki Corporation, Japan

[21] Appl. No.: 74,563

[22] Filed: Jul. 17, 1987

[51] Int. Cl.[4] ..... G08B 3/00

[52] U.S. Cl. ..... 340/384 E; 310/317; 340/692

[58] Field of Search ..... 340/384 E, 384 R, 388, 340/392, 393, 400, 407, 692; 116/137 R, 142 R, 147, 148; 310/317, 318

[56] References Cited

U.S. PATENT DOCUMENTS 3,585,405 6/1971 Stettiner ..... 310/317

FOREIGN PATENT DOCUMENTS 5583872 6/1980 Japan ..... 340/384 E

*Primary Examiner*—Joseph A. Orsino
*Assistant Examiner*—Jeffery A. Hofsass
*Attorney, Agent, or Firm*—Wigman & Cohen

[57] ABSTRACT

To activate a buzzer of voltage driven type in response to an alarm signal, the alarm driving signal generator comprises a capacitor connected between a supply voltage and the buzzer; a first transistor for intermittently discharging the capacitor in response to the alarm signal; and a second transistor for intermittently charging the capacitor in accordance with a time constant in response to a clock signal higher than the alarm signal in frequency, after the capacitor has once been discharged. The alarm buzzer can be actuated on the basis of the intermittently charged capacitor voltage. The above generator is simple in circuit configuration as compared with the conventional circuit.

5 Claims, 3 Drawing Sheets

ALARM DRIVING SIGNAL GENERATOR

BACKGROUND OF THE INVENTION

1. Field of the Invention

The present invention relates to an alarm driving signal generator for generating a signal to drive a voltage actuated alarm device such as electronic chime (piezoelectric buzzer) in response to an alarm signal.

2. Description of the Prior Art

As alarm sound producing devices, recently electronic chimes such as piezoelectric buzzers have been widely used. The piezoelectric buzzer can be actuated by voltage without passing drive current therethrough. Further, since the resonant frequency of a piezoelectric element is relatively high, a high frequency driving (voltage) signal (clock) is applied to the element to produce alarm sound. On the other hand, the buzzer is usually driven intermittently to produce a warning sound. Therefore, the high frequency driving signal is usually amplitude modulated by a low-frequency signal obtained by a CR circuit.

In the conventional alarm driving signal generator as described above, the circuit configuration is relatively complicated, and therefore there exists a problem in that the number of parts is large and the cost is high.

A more detailed description of the prior-art-alarm driving signal generator will be made with reference to the attached drawings under DETAILED DESCRIPTION OF THE PREFERRED EMBODIMENTS.

SUMMARY OF THE INVENTION

With these problems in mined, therefore, it is the primary object of the present invention to provide an alarm driving signal generator of relatively simple circuit configuration.

To achieve the above-mentioned object, an alarm driving signal generator for driving a voltage actuated buzzer in response to an alarm signal, according to the present invention, comprises: (a) a capacitor having a first terminal connected to a supply voltage via a resistor and a second terminal connected to the alarm buzzer; (b) a first switching element connected to the first terminal of said capacitor, for intermittently discharging said capacitor in response to the alarm signal; and (c) a second switching element connected to the second terminal of said capacitor, for intermittently charging said capacitor in accordance with a time constant in response to a clock signal having a frequency higher than that of the alarm signal, after said capacitor has been discharged by said first switching elements, to activate the alarm buzzer in response to voltage intermittently charged at the second terminal of said capacitor.

BRIEF DESCRIPTION OF THE DRAWINGS

The features and advantages of the alarm driving signal generator according to the present invention will be more clearly appreciated from the following description of the preferred embodiments of the invention taken in conjunction with the accompanying drawings in which.

DETAILED DESCRIPTION OF THE PREFERRED EMBODIMENTS

To facilitate understanding of the present invention, a brief reference will be made to an example of prior-art alarm signal generator with reference to the attached drawings.

Figure 1A:
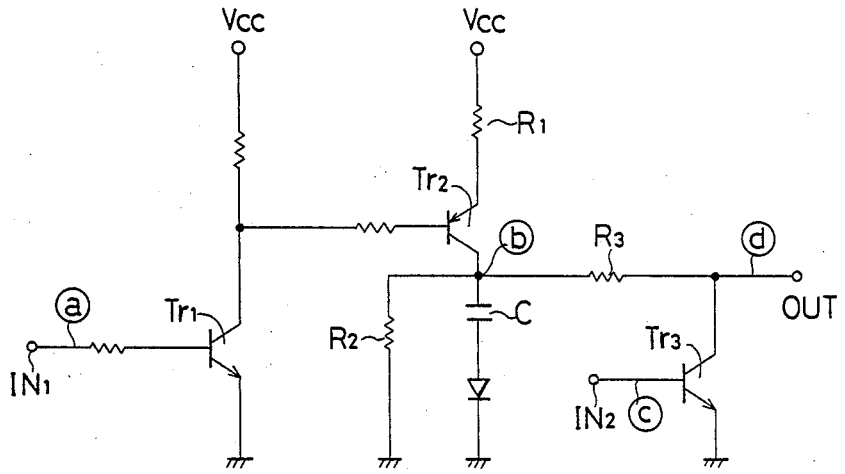
FIG.1A (Prior Art)
FIG. 1A is a circuit diagram showing a conventional alarm driving signal generator.
Figure 1B:
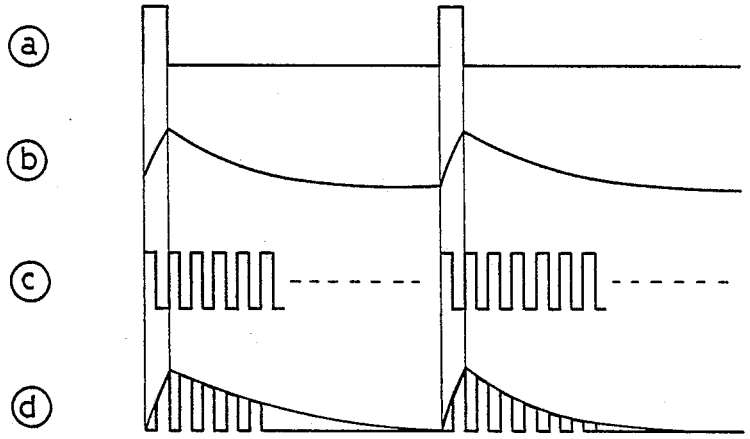
FIG.1B (Prior Art)
FIG. 1B is a timing chart showing various waveforms of the generator shown in FIG. 1A.

In FIG. 1A, the prior-art generator is composed of three, first, second and third, transistors $Tr_1$, $Tr_2$, and $Tr_3$ and a CR circuit. An alarm pulse signal as shown by a in FIG. 1B is applied to a first input terminal $IN_1$ of the first transistor $Tr_1$. A reference clock signal with a period shorter than that of the alarm pulse signal as shown by c in FIG. 1B is applied to a second input terminal $IN_2$ of the third transistor $Tr_3$. Further, the symbol Vcc denotes a supply voltage; and OUT denotes an output terminal from which an alarm driving signal for driving an electronic chime such as piezoelectric buzzer is outputted.

In operation, when an alarm pulse a is applied to the base of the first (NPN) transistor $Tr_1$, the $Tr_1$ is turned on, so that the second (PNP) transistor $Tr_2$ is turned on to charge a capacitor C via a registor $R_1$ in accordance with a time constant $CR_1$. Therefore, a point b in FIG. 1A rises relatively sharply as shown by b in FIG. 1B, as long as the alarm pulse a is kept at a high voltage level.

When the alarm pulse a falls to a low voltage level, two transistors $Tr_1$ and $Tr_2$ are both turned off, so that the capacitor is no longer charged up but discharged gradually via a resister $R_2$ (higher than $R_1$) in accordance with a time constant $CR_2$ as shown by b in FIG. 1B. The capacitor voltage is applied to the output terminal OUT via a resister $R_3$. However, since the third (NPN) transistor $Tr_3$ connected to a capacitor C is turned on or off by a clock signal as shown by c in FIG. 1B, an alarm driving signal as shown by d in Fib. 1B can be outputted from the output terminal OUT. In other words, an alarm driving signal is obtained from the output terminal OUT in such a way that the clock signal is modulated by the capacitor charging/discharging voltage waveform in amplitude.

In the above circuit shown in FIG. 1A, since the capacitor C is charged by the second (PNP) transistor $Tr_2$, it has been necessary to additionally provide another (NPN) transistor $Tr_1$ of opposite conduction type to turn on or off the $Tr_2$ in response to the alarm pulse a. Therefore, three transistors are required in total, thus resulting in a problem in that the number of parts is large and therefore the manufacturing cost is high.

In view of the above description, reference is now made of a first embodiment of the alarm driving signal generator according to the present invention.

Figure 2A:
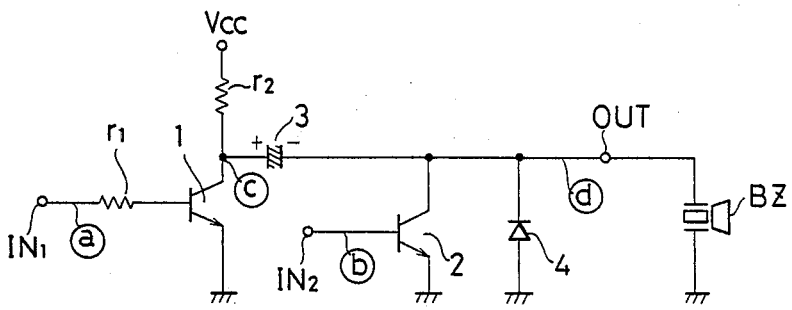
FIG. 2A is a circuit diagram showing first embodiment of the alarm driving signal generator according to the present invention.

In FIG. 2A, the generator comprises a first transistor 1, a second transistor 2, a capacitor 3, and a diode 4.

A base of the first (NPN) transistor 1 is connected to a first input terminal $IN_1$ via a resistor $r_1$; an emitter thereof is grounded; and a collector thereof is connected to a supply voltage Vcc via a resister $r_2$ and to a positive polarity of the capacitor 3 directly. On the other hand, a base of the second (NPN) transistor 2 is connected to a second input terminal $IN_2$; an emitter thereof is grounded; and a collector thereof is connected to a negative polarity of the capacitor 3. Further, a cathode of the diode 4 is connected to the negative polarity of the capacitor 3 or an output terminal OUT. A piezoelectric buzzer BZ used as an electronic chime is connected between the output terminal OUT and the ground.

Figure 2B:
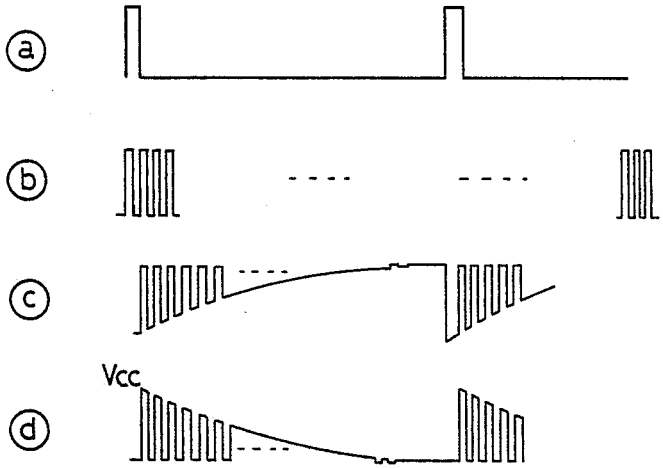
FIG. 2B is a timing chart showing various waveforms of the generator shown in FIG. 2A.

An alarm pulse a indicative of an alarm as shown by a in FIG. 2B is applied to the first input terminal $IN_1$, and a reference clock signal b as shown by b in FIG. 2B is applied to the second input terminal $IN_2$.

In operation, the alarm pulse signal a and the reference clock signal b are both applied to the first and second input terminals $IN_1$ and $IN_2$, respectively.

When the alarm pulse signal a rises to a high voltage level, since the transistor 1 is turned on, the positive terminal of the capacitor 3 drops down to the ground level, because an electric charge stored in the capacitor 3 is discharged via the diode 4. On the other hand, when the alarm pulse a falls, since the transistor 1 is turned off, a supply voltage Vcc is supplied to the positive terminal of the capacitor 3 via a resister $r_2$ to start charging up the capacitor 3.

Under these conditions, while the second transistor 2 is turned off, no current flows through the capacitor 3, so that a supply voltage difference Vcc develops across the capacitor 3. However, when the second transistor 2 is turned on, since the negative terminal of the capacitor 3 is grounded, a charge current flows through the resister $r_2$ and the capacitor 3, so that the capacitor 3 is charged up in accordance with a time constant $\tau_o = -R_oC_o$ determined by the resistance $R_o$ of the resistor $r_2$ and the capacitance $C_o$ of the capacitor 3. That is, only when the reference clock b is at a high voltage level, the capacitor 3 is charged up and therefore a voltage waveform c as shown in FIG. 2B is obtained at the positive terminal of the capacitor 3. In this case, the time constant $\tau$ of the voltage waveform can be expressed as $$\tau = R_o \cdot C_o / d$$

where d denotes a duty ratio of the reference clock.

In other words, when the second transistor 2 is turned off, since the capacitor 3 is not charged up, Vcc develops at point d. However, when the second transistor 2 is turned on, since capacitor 3 is charged up, a voltage obtained by subtracting a charged-up voltage from the supply voltage Vcc develops at point d. That is, a voltage waveform d as shown in FIG. 2B develop at the negative terminal of the capacitor 3 or at the output terminal OUT. This voltage waveform d is applied to the piezoelectric buzzer BZ. The voltage waveform d shown in FIG. 2B at the output terminal OUT is roughly the same as that d shown in FIG. 1B, so that it is possible to generate an alarm (buzzer) driving signal in the same way as in the prior art circuit shown in FIG. 1A.

Figure 3A:
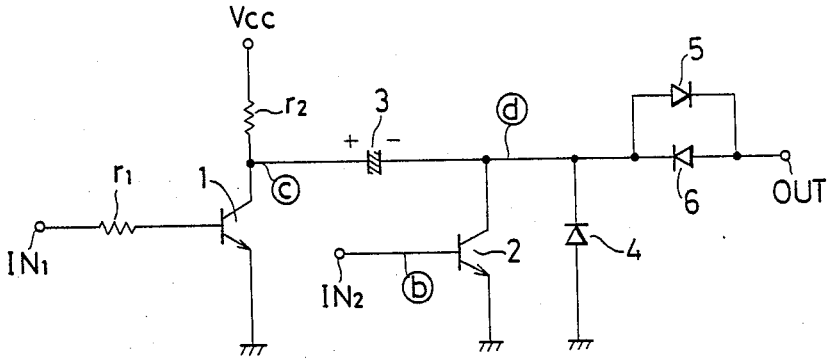
FIG. 3A is a circuit diagram showing a second embodiment of the alarm signal generator according to the present invention.

FIG. 3A shows a second embodiment of the alarm driving signal generator according to the present invention, in which two diodes 5 and 6 are additionally connected between the collector of the second transistor 2 and the output terminal OUT in opposite-directional parallel-connection relationship to each other.

The function of these diodes will be described with reference to FIG. 3B.

Figure 3B:
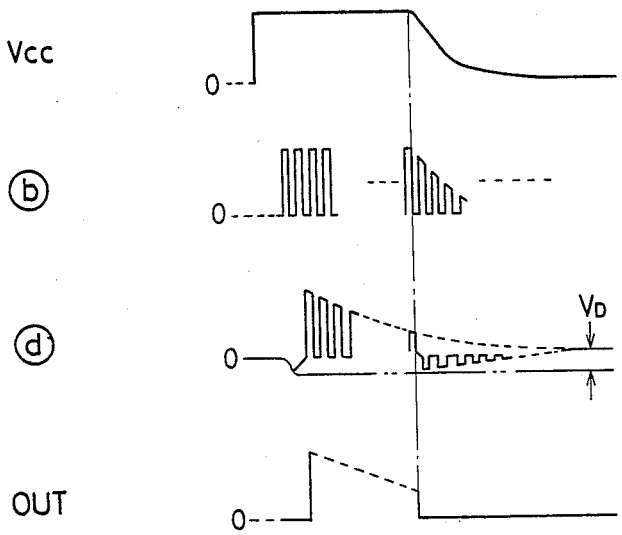
FIG. 3B is a timing chart showing waveforms of the generator shown in FIG. 3A.

In case the supply voltage Vcc is interrupted while the circuit is in operation, the supply voltage Vcc and therefore the collector voltage of the transistor 1 drops sharply in accordance with a time constant as shown by Vcc in FIG. 3B. Further, the reference clock may drop as shown by b in FIG. 3B. At this moment, if an electric charge remains in the capacitor 3, this electric charge is discharged quickly across the capacitor 3 by way of the first transistor 1, ground and the diode 4, so that a negative voltage corresponding to a forward voltage $V_D$ (about 0.7V) of the diode 4 is generated at the negative terminal of the capacitor 3. Under these conditions, in case the second transistor 2 is still turned on by the remaining reference clock, the voltage level at the negative terminal of the capacitor 3 drops down to the ground, so that a negative pulse signal turned on or off on the negative side as shown by d in FIG. 3B develops at the cathode of the diode 4. This reverse alarm driving signal is not preferable because an abnormal sound may be produced when applied to the piezoelectric buzzer BZ.

In the circuit shown in FIG. 3A, however, since a pair of opposite-direction parallel-connected diodes 5 and 6 are connected between the capacitor 3 and the output terminal OUT, although the normal alarm driving signal is applied from the output terminal OUT to the buzzer BZ via the diode 5, the abnormal alarm driving signal (negative alarm driving signal) will not be applied to buzzer BZ, because the voltage level of the abnormal alarm driving signal is below the forward voltage $V_D$ of the diode 6.

In the alarm driving signal generator of the present invention, since the circuit can be configured by only two NPN transistors of the same conduction type without use of a PNP transistor, it is possible to reduce the number of parts and the cost thereof.

What is claimed is:

1. An alarm driving signal generator for driving a voltage actuated buzzer in response to an alarm signal, which comprises:

(a) a capacitor having a first terminal connected to a supply voltage via a resistor and a second terminal conected to the alarm buzzer;

(b) a first switching element connected to the first terminal of said capacitor, for intermittently discharging said capacitor in response to the alarm signal; and (c) a second switching element connected to the second terminal of said capacitor, for intermittently charging said capacitor in accordance with a time constant in response to a clock signal having a frequency higher than that of the alarm signal, after said capacitor has been discharged by said first switching elements, to activate the alarm buzzer in response to voltage intermittently charged on the second terminal of said capacitor.

2. The alarm driving signal generator as set forth in claim 1, which further comprises a first diode having an anode connected to ground and a cathode connected to the second terminal of said capacitor, for discharging electric charge stored in said capacitor when said first switching element is activated.

3. The alarm driving signal generator as set forth in claim 2, which further comprises a pair of reverse-direction parallel connected diodes connected between the second terminal of said capacitor and the buzzer, for preventing an abnormal negative voltage pulse signal generated just after the supply voltage Vcc has been turned off from being applied to the buzzer.

4. The alarm driving signal generator as set forth in claim 1, wherein said capacitor is intermittently charged at the second terminal thereof in accordance with a time constant $\tau$ expressed as $$\tau = R_o \cdot C_o \cdot 1/d$$

where $R_o$ denotes a resistance of the resistor connected between the supply voltage and said capacitor; $C_o$ denotes a capacitance of said capacitor; and d is a duty ratio of the clock signal.

5. The alarm driving signal generator as set forth in claim 1, wherein said first and second switching elements are transistors.

* * * * *